United States Patent [19]

Juvonen

[11] 4,084,486

[45] Apr. 18, 1978

[54] HYDRAULICALLY DRIVEN STRIKING DEVICE

[75] Inventor: Väinö Esko Juvonen, Klaukkala, Finland

[73] Assignee: Linden-Alimak AB, Skelleftea, Sweden

[21] Appl. No.: 696,412

[22] Filed: Jun. 15, 1976

[30] Foreign Application Priority Data

Jun. 26, 1975 Finland ..... 751895

[51] Int. Cl.[2] ..... F01B 7/18; F01L 25/06; F01L 17/00

[52] U.S. Cl. ..... 91/276; 91/319; 91/320; 91/321; 91/328

[58] Field of Search ..... 91/276, 328, 286, 321, 91/319, 320

[56] References Cited

U.S. PATENT DOCUMENTS

| | | | |
|---|---|---|---|
| 3,965,799 | 6/1976 | Juvonen | 91/276 |
| 3,969,984 | 7/1976 | Bouyoucos | 91/328 |

*Primary Examiner*—Paul E. Maslousky

*Attorney, Agent, or Firm*—Cushman, Darby & Cushman

[57] ABSTRACT

In a hydraulic striking device having a reciprocating piston there are first and second cylindrical spaces surrounding the piston, the first space continuously communicating with a high pressure circuit and the second space alternately communicating with the high pressure circuit and a low pressure circuit. A special sleeve-shaped control valve in the second space reciprocates axially of the piston to achieve the desired operation.

3 Claims, 2 Drawing Figures

HYDRAULICALLY DRIVEN STRIKING DEVICE

The present invention relates to a hydraulically driven striking device, comprising a frame, a striking piston striking against a tool and moving in the stroke and return direction in the frame, a high pressure circuit and a low pressure circuit formed in the frame, a first cylinder space surrounding the striking piston and continuously communicating with the high pressure circuit, a second cylinder space surrounding the striking piston and alternately communicating with the high pressure and low pressure circuit, and a sleeve shaped control valve positioned in the latter cylinder space and surrounding the piston, said control valve being arranged to control the coupling of the second cylinder space to the high and low pressure circuit by moving in the cylinder space in the stroke and return direction of the striking piston essentially synchronously with the striking piston, the hydraulic fluid thereby pushing the control valve in the return direction, whereby, when the striking piston stops when striking against the tool, the control valve continues to move in the stroke direction, thus disconnecting the connection from the second cylinder space to the low pressure circuit and opening the connection from the second cylinder space to the high pressure circuit, and an annular chamber being formed in the wall of the second cylinder space and the outer wall of the control valve being provided with a corresponding pressure action surface.

In striking devices of this type (Finnish Pat. No. 50,307), the control valve is made to move in the stroke direction so that the piston strikes against the control valve after it has finished its return motion. During the entire striking motion, the piston pushes the control valve ahead of itself until the piston strikes against the tool, e.g., a drill, whereafter the control valve continues to move in the stroke direction by itself.

It is the object of the present invention to improve such a kind of striking device further, and, for this purpose, the striking device according to the invention is mainly characterized in that the annular chamber is arranged to be coupled to the high pressure circuit in the initial stage of the striking motion of the striking piston, the control valve thereby obtaining an initial speed lower than the speed of the striking piston in the stroke direction so that the striking piston reaches the control valve and pushes it ahead of itself shortly before striking against the tool. The efficiency of the device is considerably improved because the control valve is given an initial speed in the stroke direction by means of hydraulic fluid. Owing to this between the control valve and the piston at the moment when the piston reaches the control valve is very small whereby the kinetic energy lost by the piston to the control valve is very small. Further, the impact between the piston and the control valve will be more gentle, thereby avoiding possible mechanical damages.

The invention will now be described by way of example with reference to the accompanying drawings wherein:

Figure 1:
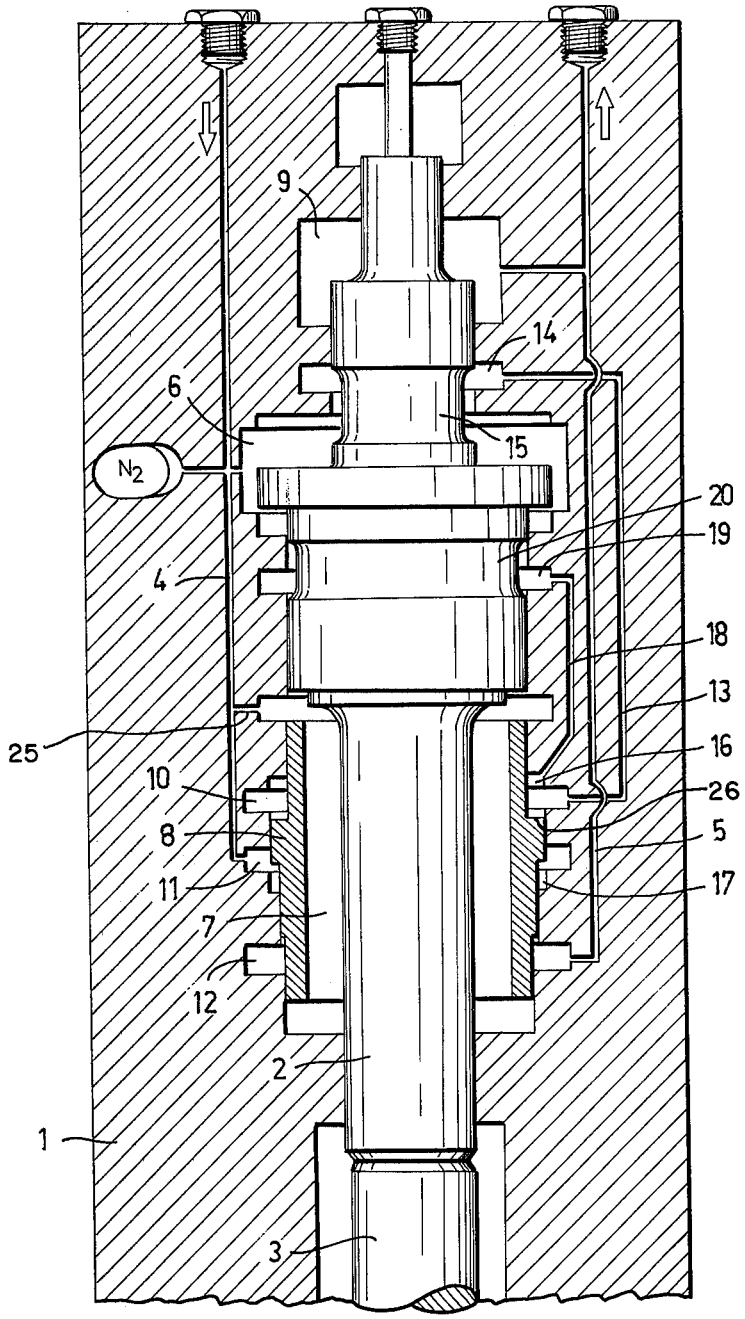
FIG. 1 is a longitudinal sectional view with the piston in a position where it strikes against the tool while the control valve is still on the way down.

The striking device shown in the drawing, preferably a rock drilling machine, essentially comprises a frame 1 and a striking piston 2 located in a cavity in the frame, said valve moving in the stroke and return direction (down and up in the drawing) and striking against a tool shaft 3 inserted in the front end of the frame to drive the tool, e.g., a drill, into the ground or into a rock. The frame is provided with a high pressure circuit 4 and a low pressure circuit 5 for transport of hydraulic fluid. The striking valve is partly surrounded by a rear cylinder space 6 communicating continuously with the high pressure circuit, and a front cylinder space 7 communicating alternately with the high pressure and low pressure circuit.

Inside the last-mentioned front cylinder space 7, a sleeve shaped control valve 8 surrounding the piston 2 is located. This control valve controls the pressure in the front cylinder space by moving in the stroke and return direction of the return piston essentially synchronously with the striking piston, thereby closing in its rear (upper) end position the connection or first part means 25 between the high pressure circuit and the cylinder space 7 and opening the connection to the low pressure circuit, and in its front end position opening the connection from the high pressure circuit and closing the connection to the low pressure circuit.

The rear end of the piston is, moreover, surrounded by a cylindrical chamber 9 communicating continuously with the low pressure circuit.

The motions of the control valve 8 are controlled by three cylindrical chambers 10, 11 and 12 provided in the wall of the cylinder space 7 and by three radial pressure action surfaces such as a first shoulder 26 and the shoulder facing in the opposite direction as shoulder 26 in the outer surface of the control valve.

As appears from the figure, the chamber 11 communicates continuously with the high pressure circuit 4. In this way, an action of force is provided which continuously strives to move the control valve in the return direction. The chamber 10 can be alternately connected to the high pressure space 6 and low pressure chamber 9 through a channel 13, a groove 14 in the frame and a groove 15 in the piston. When the chamber 10 communicates with the high pressure space 6, a force acting in the stroke direction is imposed on the control valve, and when said chamber communicates with the low pressure chamber 9, an action of force is produced in the return direction. The third chamber 12 communicates continuously with the low pressure circuit.

Figure 2:
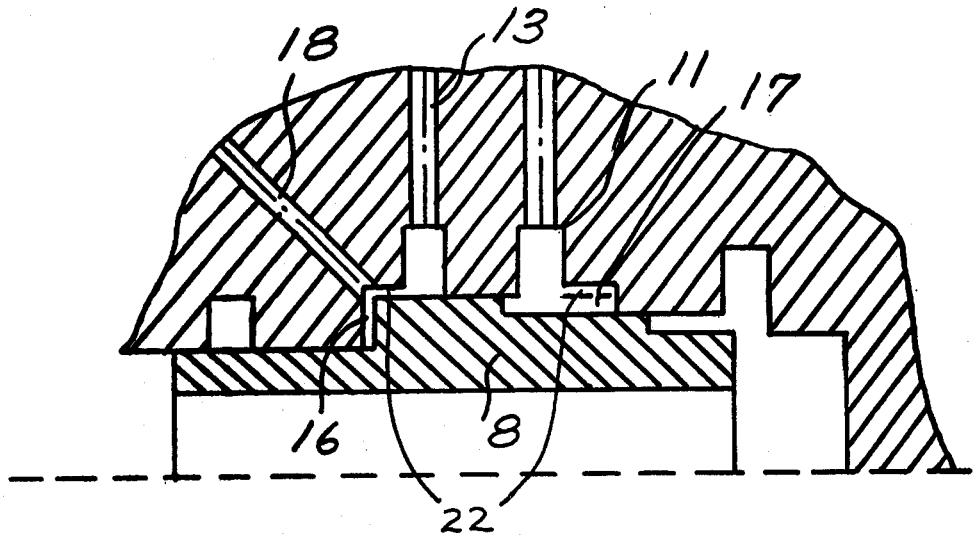
FIG. 2 is an enlarged sectional view showing the clearances between the control valve and the walls of the chamber.

The chambers 10 and 11 are provided with a damping chamber 16 and 17, respectively, both serving to exert a braking effect on the motions of the control valve near the end positions thereof. The damping chamber 16 acts in the return direction and the damping chamber 17 in the stroke direction. The action of these chambers is based on the fact that a radial tolerance as at 22 (shown in FIG. 2) is provided between the control valve and the frame, said tolerance choking the flow of oil in a desired manner. This kind of damping, however, suffers from the disadvantage that it makes it impossible to quickly accelerate the control valve out of the chamber in question. According to a preferred embodiment of the invention, this disadvantage has been eliminated by connecting the damping chamber 16, to accelerate the control valve, through a channel 18 to a groove 19 in the frame which, depending on the position of the piston, can be connected to the high pressure space 6 through a groove 20 in the piston. The control valve can move in the return direction only when the piston is in the rear position, the connection from the chamber 16 to the space 6 thereby being disconnected due to the fact that the cylinder surface of the piston plugs the groove 19.

The acceleration of the control valve in the return direction out of the damping chamber 17 is accomplished because the pressure action surface of the control valve in the space 7 is bigger in the return direction than in the stroke direction. This can be stated also so that the pressure action surface corresponding to the chamber 10 is bigger than the sum of the pressure action surfaces corresponding to chambers 11 and 12.

When the piston 2 moves in the stroke direction, the control valve 8 is accelerated separately nearly to the same speed as the piston. The piston reaches the control valve shortly before it strikes against the tool 3 and pushes the control valve ahead of itself in the stroke direction. This ensures that the control valve obtains a desired minimum speed which is as big as the speed of the piston. The control valve continues to move with this speed in the stroke direction also after the piston has stopped and closes the connection from the space 7 to the low pressure circuit and opens the connection to the high pressure circuit.

The immediate contact or mediate contact through an oil cushion between the piston and the control valve shortly before the piston strikes against the tool ensures an accurate synchronism between the motions of both these organs which is essential for the efficiency of the device. The chamber 11 ensures that the control valve, after having disconnected the connection between the high pressure circuit 4 and cylinder space 7, moves on in the return direction up to the damping chamber 16. Owing to this, the valve can be given exactly the desired speed in the stroke direction and the contact between the valve and piston always takes place at the right point.

I claim:

1. In a hydraulically operated percussion apparatus comprising a housing having a bore in which an impact piston is reciprocatingly movable between a retracted end position and an impact end position in contact with an impact tool for transferring impact energy to said impact tool, pressure chambers defined between said housing and said piston and a channel system including a high pressure and a low pressure branch for conducting hydraulic pressure fluid to and from said pressure chambers, a first one of said pressure chambers surrounding said piston and being defined, at the end of said chamber remote from said impact tool, by an annular shoulder on said piston, and at its opposite end, by an annular surface of said housing, a second pressure chamber being open to said low pressure branch, a third pressure chamber being open to said high pressure branch, first and second port means opening into said first chamber and communicating respectively with said high pressure branch and low pressure branch, said second port means being located between said first port means and said annular surface of said housing, a sleeve shaped distribution valve member surrounding said piston in said first pressure chamber and being reciprocatingly movable in response to the reciprocating movement of said piston, a first valve chamber defined between said distribution valve member and a first recess in the surface of said bore between said first and second port means, said valve member having a first shoulder means facing toward said first port means and communicating with said first valve chamber, said valve member being movable between (a) a first end position in which said first port means is covered and said second port means is uncovered, (b) an intermediate position in which both port means are covered, and in which, during operation of said apparatus, said valve member and said piston are in contact in said impact position of the latter, and, (c) a second end position, out of contact with said piston, in which said first port means is uncovered and said second port means is covered, the improvement comprising:

first valve means connecting said first valve chamber to said high pressure branch through said second pressure chamber in response to said piston moving a selected distance from said retracted end position, second valve means connecting said first valve chamber to said low pressure branch through said third pressure chamber in response to said piston moving a distance less than said selected distance from said retracted end position, a second valve chamber communicating with said high pressure branch and defined by a portion of said distribution valve member and a second recess in the surface of said bore between said first and second port means, said distribution valve member having a second shoulder means facing said second port means and communicating with said second valve chamber, said first shoulder means having a greater surface area than said second shoulder means, said distribution valve member having at its opposite ends pressure actuated surfaces in said first pressure chamber which at one of said ends has a greater surface area facing in the direction of said tool than the surface area of the other end of said valve member facing in the direction of the said retracted end position of said piston, the pressure actuated surfaces of said first and second shoulder means of said valve member and the pressure actuated surfaces of said piston being dimensioned such that said piston hits said valve member shortly before said piston impacts against said tool.

2. The apparatus as claimed in claim 1, wherein said second pressure chamber in communication with said low pressure branch is located near the end of said piston remote from said tool, said third pressure chamber being disposed between said first and second pressure chambers and communicating with said high pressure branch, said piston having in each of said second and third pressure chambers shoulder means having pressure actuated surfaces, a fourth pressure chamber disposed between said second and third pressure chambers and communicating with said first valve chamber, recess means in the surface of said piston and interconnecting said fourth pressure chamber and said third pressure chamber when said piston takes a position beyond said predetermined distance, and to interconnect said fourth and second pressure chambers when said piston takes a position short of said selected distance from said retracted position.

3. Apparatus as claimed in claim 1, further comprising a damping chamber associated with said first valve chamber, said damping chamber being located to receive said first shoulder means of said valve member in said first end position thereof and to thereby serve as a damping means for said valve member when reaching said first end position, valve means connecting said damping chamber to said high pressure branch in response to said piston taking a position beyond said selected distance from said retracted end position.

* * * * *